US009382788B2

(12) United States Patent
Parsche

(10) Patent No.: US 9,382,788 B2
(45) Date of Patent: Jul. 5, 2016

(54) SYSTEM INCLUDING COMPOUND CURRENT CHOKE FOR HYDROCARBON RESOURCE HEATING AND ASSOCIATED METHODS

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 381 days.

(21) Appl. No.: 14/066,919

(22) Filed: Oct. 30, 2013

(65) Prior Publication Data

US 2015/0114645 A1 Apr. 30, 2015

(51) Int. Cl.

| | |
|---|---|
| ***E21B 43/00*** | (2006.01) |
| ***E21B 43/14*** | (2006.01) |
| ***E21B 43/24*** | (2006.01) |
| ***E21B 36/04*** | (2006.01) |

(52) U.S. Cl.

CPC ..... *E21B 43/2401* (2013.01); *E21B 36/04* (2013.01); *H05B 2214/03* (2013.01)

(58) Field of Classification Search

CPC ..... E21B 43/14; E21B 43/00; E21B 36/00; E21B 43/2401; E21B 36/04; E21B 43/2406; E21B 43/2408; E21B 36/005; E21B 47/122; H05B 2214/03; H05B 6/80; H01Q 1/04

See application file for complete search history.

(56) References Cited

U.S. PATENT DOCUMENTS

| | | | | |
|---|---|---|---|---|
| 4,140,179 | A | 2/1979 | Kasevich et al. | |
| 4,180,819 | A * | 12/1979 | Nakano | H01Q 9/18 343/792 |
| 4,508,168 | A | 4/1985 | Heeren | |
| 5,293,936 | A * | 3/1994 | Bridges | E21B 36/04 166/248 |
| 5,440,317 | A * | 8/1995 | Jalloul | H01Q 1/084 343/702 |
| 5,829,519 | A * | 11/1998 | Uthe | B09C 1/06 166/248 |
| 7,461,693 | B2 * | 12/2008 | Considine | B08B 9/0933 166/248 |
| 7,891,421 | B2 * | 2/2011 | Kasevich | E21B 43/003 166/177.1 |
| 8,096,349 | B2 * | 1/2012 | Considine | E21B 43/2401 166/302 |
| 9,016,367 | B2 * | 4/2015 | Wright | E21B 43/2401 166/242.3 |
| 9,194,221 | B2 * | 11/2015 | Parsche | H01Q 9/16 |
| 9,196,411 | B2 * | 11/2015 | Parsche | E21B 43/2401 |
| 2012/0067580 | A1 * | 3/2012 | Parsche | E21B 43/2401 166/302 |
| 2013/0048277 | A1 * | 2/2013 | Parsche | E21B 43/2406 166/272.1 |
| 2014/0152312 | A1 * | 6/2014 | Snow | E21B 43/2401 324/332 |
| 2014/0262222 | A1 * | 9/2014 | Wright | E21B 36/04 166/248 |
| 2014/0262223 | A1 * | 9/2014 | Wright | E21B 36/04 166/248 |
| 2014/0262224 | A1 * | 9/2014 | Ayers | E21B 43/2401 166/248 |
| 2015/0070112 | A1 | 3/2015 | Wright et al. | |
| 2015/0083387 | A1 | 3/2015 | Wright et al. | |
| 2015/0114645 | A1 * | 4/2015 | Parsche | E21B 43/2401 166/302 |
| 2015/0211336 | A1 * | 7/2015 | Wright | E21B 43/2401 166/302 |

* cited by examiner

*Primary Examiner* — Daniel P Stephenson

(74) *Attorney, Agent, or Firm* — Allen, Dyer, Doppelt, Milbrath & Gilchrist, P.A.

(57) ABSTRACT

A system for heating a hydrocarbon resource in a subterranean formation having a wellbore extending therein, the system including a radio frequency (RF) source, an RF antenna configured to be positioned within the wellbore, a transmission line coupling the RF source and the RF antenna, and a compound current choke surrounding the transmission line. The compound current choke includes a plurality of spaced apart, overlapping, electrically conductive sleeves. Each of the plurality of spaced apart, overlapping, electrically conductive sleeves may have a first open end and a second closed end coupled to the transmission line.

21 Claims, 6 Drawing Sheets

SYSTEM INCLUDING COMPOUND CURRENT CHOKE FOR HYDROCARBON RESOURCE HEATING AND ASSOCIATED METHODS

FIELD OF THE INVENTION

The present invention relates to the field of hydrocarbon resource heating, and, more particularly, to hydrocarbon resource heating from a wellbore in a subterranean formation using electromagnetic energy and related methods.

BACKGROUND OF THE INVENTION

Subterranean formation heating using electromagnetic energy relates to the technology for heating of bitumen and/or heavy oil in oil-sand mediums using radio frequency (electromagnetic) energy. Radio frequency heating uses antennas or electrodes to heat the buried formation. This enables a quick and efficient heating of hydrocarbons by coupling antennas into the formation. As a result, the heated hydrocarbons become less viscous which aids in oil production.

Materials such as oil shale, tar sands, and coal are amenable to heat processing to produce hydrocarbon liquids. Generally, the heat develops the porosity, permeability, and/or mobility necessary for recovery. Oil shale is a sedimentary rock, which upon pyrolysis, or distillation, yields a condensable liquid, referred to as a shale oil, and non-condensable gaseous hydrocarbons. The condensable liquid may be refined into products that resemble petroleum products. Oil sand is an erratic mixture of sand, water, and bitumen, with the bitumen typically being present as a film around water-enveloped sand particles. Though difficult, various types of heat processing can release the bitumen, which is an asphalt-like crude oil that is highly viscous.

A number of proposals, broadly classed as in-situ methods, have been made for processing and recovering hydrocarbon deposits. Such methods may involve underground heating of material in place, with little or no mining or disposal of solid material in the formation. Useful constituents of the formation, including heated liquids of reduced viscosity, may be drawn to the surface by a pumping system or forced to the surface by injection techniques. For such methods to be successful, the amount of energy required to effect the extraction should be minimized.

One proposed electrical in situ approach employs a set of arrays of dipole antennas located in a plastic or other dielectric casing in a formation, such as a tar sand formation. A VHF or UHF power source would energize the antennas and cause radiating far fields to be emitted into the deposit. However, at these frequencies, and considering the electrical properties of the formations, the field intensity drops rapidly as distance from the antennas increases. Consequently, non-uniform heating results in inefficient overheating of portions of formations to obtain at least minimum average heating of the bulk of the formation.

Many efforts have been attempted or proposed to heat large volumes of subsurface formations in situ using electric resistance, gas burner heating, steam injection and electromagnetic energy, such as to obtain kerogen oil and gas from oil shale. Resistance type electrical elements have been positioned down a borehole via a power cable to heat the shale via thermal conduction. Unfortunately, the thermal conductivity of oil sand is low, under about 2 watts/meter degree Kelvin so conducted heat flow is slow. Electromagnetic energy has been delivered via an antenna or microwave applicator. The antenna is positioned down a borehole via a coaxial cable or waveguide connecting it to a high-frequency power source on the surface. Subterranean formation heating is accomplished by eddy currents, radiation and dielectric absorption of the energy of the electromagnetic (EM) wave radiated by the antenna or applicator. This may be better than more common resistance heating which relies solely on conduction to transfer the heat. It is also better than steam heating which requires large amounts of water and energy present at the site.

U.S. Pat. No. 4,140,179 discloses a system and method for producing subsurface heating of a formation comprising a plurality of groups of spaced RF energy radiators (dipole antennas) extending down boreholes to oil shale. The antenna elements should be matched to the electrical conditions of the surrounding formations. However, as the formation is heated, the electrical conditions can change whereby the dipole antenna elements may have to be removed and changed due to changes in temperature and content of organic material.

U.S. Pat. No. 4,508,168 describes an RF applicator positioned down a borehole supplied with electromagnetic energy through a coaxial transmission line whose outer conductor terminates in a choking structure comprising an enlarged coaxial stub extending back along the outer conductor.

However, RF currents flow along the outside of the coaxial cable (e.g. common mode current) and result in unwanted overburden heating or even undesired surface heating. The conventional sleeve baluns or common mode chokes are intended to stop the unwanted current but existing balun chokes are too long and may preclude or impede surface operation. Bending the choke at the surface reduces the effectiveness as stray capacitance to the antenna allows RF currents to circumvent the balun. Also, a bent balun may still present an oversize structure requiring excessive wellpad area. Thus, a shorter balun choke is desired.

SUMMARY OF THE INVENTION

In view of the foregoing background, it is therefore an object of the present invention to provide a shorter common mode current choke for RF antennas, for example, used in subterranean heating.

This and other objects, features, and advantages in accordance with the present invention are provided by a system for heating a hydrocarbon resource in a subterranean formation having a wellbore extending therein, the system including a radio frequency (RF) source, an RF antenna configured to be positioned within the wellbore, a transmission line coupling the RF source and the RF antenna, and a compound current choke surrounding the transmission line. The compound current choke includes a plurality of spaced apart, overlapping, electrically conductive sleeves.

Each of the plurality of spaced apart, overlapping, electrically conductive sleeves may be copper and may have a first open end and a second closed end coupled to the transmission line. Also, the plurality of spaced apart, overlapping, electrically conductive sleeves may have respective circular cross-sections of progressively increasing diameter from an innermost electrically conductive sleeve to an outermost electrically conductive sleeve.

The transmission line may be a coaxial transmission line comprising an inner conductor and an outer conductor surrounding the inner conductor. The compound current choke is coupled to the outer conductor. The RF antenna may be a dipole antenna.

The compound current choke may have a length inversely proportional to a number of the plurality of spaced apart, overlapping, electrically conductive sleeves. The compound current choke may also include a fill material within spaces defined between the plurality of spaced apart, overlapping, electrically conductive sleeves and the transmission line. As such, the length L may be defined by $L=c/4nf\sqrt{(\in r\mu r)}$, where c is the speed of light in feet per second, n is a number of electrically conductive sleeves, f is frequency in Hertz of the RF source, $\in r$ is the relative permittivity of the fill material, and $\mu r$ is the relative permeability of the fill material.

Another aspect is a method for heating a hydrocarbon resource in a subterranean formation having a wellbore extending therein. The method includes supplying radio frequency (RF) power, from an RF source and via a transmission line, to an RF antenna positioned within the wellbore, and reducing a common mode current from propagating on an outside of the transmission line toward the RF source using a compound current choke surrounding the transmission line and comprising a plurality of spaced apart, overlapping, electrically conductive sleeves.

Each of the plurality of spaced apart, overlapping, electrically conductive sleeves may be copper and may have a first open end and a second closed end coupled to the transmission line. Also, the plurality of spaced apart, overlapping, electrically conductive sleeves may have respective circular cross-sections of progressively increasing diameter from an innermost electrically conductive sleeve to an outermost electrically conductive sleeve.

The transmission line may be a coaxial transmission line comprising an inner conductor and an outer conductor surrounding the inner conductor. The compound current choke is coupled to the outer conductor. The compound current choke may further comprise a fill material within spaces defined between the plurality of spaced apart, overlapping, electrically conductive sleeves and the transmission line.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
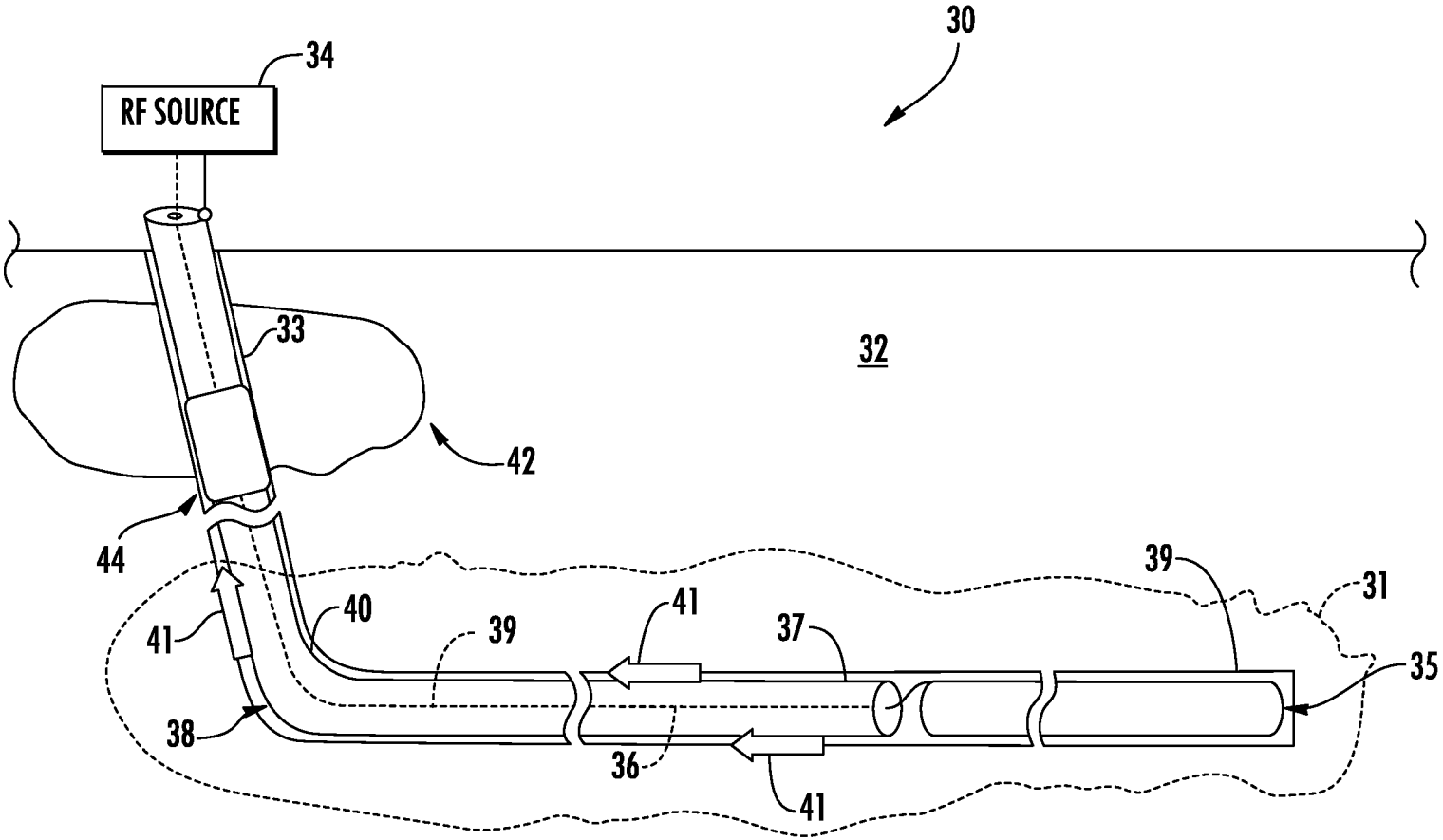
FIG. 1 is a schematic diagram illustrating a system for heating a hydrocarbon resource in accordance with an embodiment of the present invention.

Referring initially to FIG. 1, a system 30 for heating a hydrocarbon resource 31 (e.g., oil sands, etc.) in a subterranean formation 32 having a wellbore 33 therein is first described. In the illustrated example, the wellbore 33 is a laterally extending wellbore, such as a horizontal directional drilling (HDD) wellbore, although the system 30 may be used with vertical or other wellbores in different configurations. The system 30 further includes a radio frequency (RF) source 34 for an RF antenna 35 that is positioned in the wellbore 33 adjacent the hydrocarbon resource 31. The RF source 34 is positioned above the subterranean formation 32, and may be an RF power generator, for example. In an exemplary implementation, the laterally extending wellbore 33 may extend about 1,000 feet in length within the subterranean formation 32, and about 50 feet underground, although other depths and lengths may be used in different implementations.

Although not shown, in some embodiments a second wellbore may be used below the wellbore 33, such as in a SAGD implementation, for collection of petroleum, etc., released from the subterranean formation 32 through heating. The second wellbore may optionally include a separate antenna for providing additional heat to the hydrocarbon resource 31, as would be appreciated by those skilled in the art.

A transmission line 38 extends within the wellbore 33 between the RF source 34 and the RF antenna 35. The RF antenna 35 includes an inner conductor section 36 and an outer conductor section 37, which advantageously may define a dipole antenna. However, it will be appreciated that other antenna configurations may be used in different embodiments. Antenna isolators may separate the various sections, and these conductor sections may be coaxial in some embodiments. The conductor sections 36/37 will typically be partially or completely exposed to radiate RF energy into the hydrocarbon resource 31, e.g. unshielded where RF heating is desired.

The transmission line 38 may include a plurality of separate segments which are successively coupled together as the RF antenna is pushed or fed down the wellbore 33. The transmission line 38 may also include an inner conductor 39 and an outer tubular conductor 40, which may be separated by a dielectric material D, for example. A dielectric may also surround the outer tubular conductor 40, if desired. In some configurations, the inner conductor 39 and the outer tubular conductor 40 may be coaxial, although other transmission line conductor configurations may also be used in different embodiments. For instance, there may be 3 or more concentric conductors with transposed polarities to increase conductor surface area or reduce characteristic impedance.

In accordance with embodiments herein, electromagnetic radiation provides heat to the hydrocarbon formation, which allows heavy hydrocarbons to flow. In those embodiments, no steam is actually necessary to heat the formation, which provides a significant advantage especially in hydrocarbon formations that are relatively impermeable and of low porosity, which makes traditional SAGD systems slow to start. As well, caprock to contain injection steam may not be required. The penetration of RF energy is not inhibited by mechanical constraints, such as low porosity or low permeability. In fact, RF energy can break rocks containing pore water such as shale. However, RF energy can be beneficial to preheat the formation prior to steam application or vice versa.

Radio frequency (RF) heating is heating using one or more of three energy forms: electric currents, electric fields, and magnetic fields at radio frequencies. Depending on operating parameters, the heating mechanism may be resistive by joule effect or dielectric by molecular moment. Resistive heating by joule effect is often described as electric heating, where electric current flows through a resistive material. Dielectric heating occurs where polar molecules, such as water, change orientation when immersed in an electric field. Magnetic fields also heat electrically conductive materials through formation of eddy currents, which then heat resistively.

RF heating can use electrically conductive antennas to function as heating applicators. The antenna is a passive device that converts applied electrical current into electric fields, magnetic fields, and electrical currents in the target material, without having to heat the structure to a specific threshold level. Preferred antenna shapes can be Euclidian geometries, such as lines and circles. As oil wells are generally linear or line shaped curl may difficult so divergent, dipole antennas may be preferred. Additional background information on dipole antennas can be found at S. K. Schelkunoff & H. T. Friis, Antennas: Theory and Practice, pp 229-244, 351-353 (Wiley New York 1952). The radiation patterns of antennas can be calculated by taking the Fourier transforms of the antennas' electric current flows. Modern techniques for antenna field characterization may employ digital computers and provide for precise RF heat mapping, including both near and far fields.

Susceptors are materials that heat in the presence of RF energies. Salt water is a particularly good susceptor for RF heating; it can respond to all three types of RF energy. Oil sands and heavy oil formations commonly contain connate liquid water, dissolved carbon dioxide, and or salt in sufficient quantities to serve as a RF heating susceptor. For instance, in the Athabasca region of Canada and at 1 KHz frequency, rich oil sand (15% bitumen) may have about 0.5-2% water by weight, an electrical conductivity of about 0.01 s/m (siemens/meter), and a relative dielectric permittivity of about 120. As bitumen melts below the boiling point of water, even at low pore pressure, liquid water may be a used as an RF heating susceptor during bitumen extraction, permitting well stimulation by the application of RF energy.

In general, RF heating has superior penetration to conductive heating in hydrocarbon formations. RF heating may also have properties of thermal regulation because steam is a not an RF heating susceptor.

Although not so limited, heating from the present embodiments may primarily occur from reactive near fields rather than from radiated far fields. The heating patterns of electrically small antennas in uniform media may be simple trigonometric functions associated with canonical near field distributions. For instance, a single line shaped antenna, for example, a dipole, may produce a toroidal or football shaped heating pattern due to the cosine distribution of radial electric fields as displacement currents (see, for example, Antenna Theory Analysis and Design, Constantine Balanis, Harper and Roe, 1982, equation 4-20a, pp 106). In practice, however, hydrocarbon formations are generally inhomogeneous and anisotropic such that realized heating patterns are substantially modified by formation geometry. Multiple RF energy forms including electric currents, electric fields, and magnetic fields interact as well, such that canonical solutions or hand calculation of heating patterns may not be practical or desirable.

Heating patterns may be predicted by logging the electromagnetic parameters of the hydrocarbon formation a priori, for example, conductivity measurements can be taken by induction resistivity and permittivity by placing tubular plate sensors in exploratory wells. The RF heating patterns are then calculated by numerical methods in a digital computer using method or moments algorithms such as the Numerical Electromagnetic Code Number 4.1 by Gerald Burke and the Lawrence Livermore National Laboratory of Livermore Calif.

Far field radiation of radio waves (as is typical in wireless communications involving antennas) does not significantly occur in antennas immersed in hydrocarbon formations. Rather the antenna fields are generally of the near field type so the flux lines begin and terminate on the antenna structure. In free space, near field energy rolls off at a $1/r^3$ rate (where r is the range from the antenna conductor) and for antennas small relative wavelength it extends from there to $\lambda/2\Pi$ (lambda/2 pi) distance, where the radiated field may then predominate. In the hydrocarbon formation, however, the antenna near field behaves much differently from free space. Analysis and testing has shown that dissipation causes the roll off to be much higher, about $1/r^5$ to $1/r^8$. This advantageously may limit the depth of heating penetration in the present embodiments to substantially that of the hydrocarbon formation.

Thus, the present approach can accomplish stimulated or alternative well production by application of RF electromagnetic energy in one or all of three forms: electric fields, magnetic fields and electric currents for increased heat penetration and heating speed. The RF heating may be used alone or in conjunction with other methods and the applicator antenna is provided in situ by the well tubes through devices and methods described.

Due to RF skin effect, RF currents 41 (e.g. common mode current) can sneak up the outside of the coaxial cable 38 and result in unwanted overburden 42 heating, undesired surface 32 heating or even a personnel hazard. The overburden is frequently more electrically conductive than the hydrocarbon ore, so it may heat more readily than the hydrocarbon ore, and the present invention advantageously prevents the unwanted overburden heating. The conventional sleeve baluns or common mode chokes are intended to stop the unwanted current but existing balun chokes are too long and may preclude or impede surface operation. For example, existing balun chokes may be ¼ wavelength long, and if the hydrocarbon resources are less than ¼ wavelength below the surface, then surface space may be needed at the site for the balun. An improved approach for reducing or eliminating a common mode current from having undesirable effects during subterranean RF heating of hyrdrocarbon resources is now described.

Figure 2:
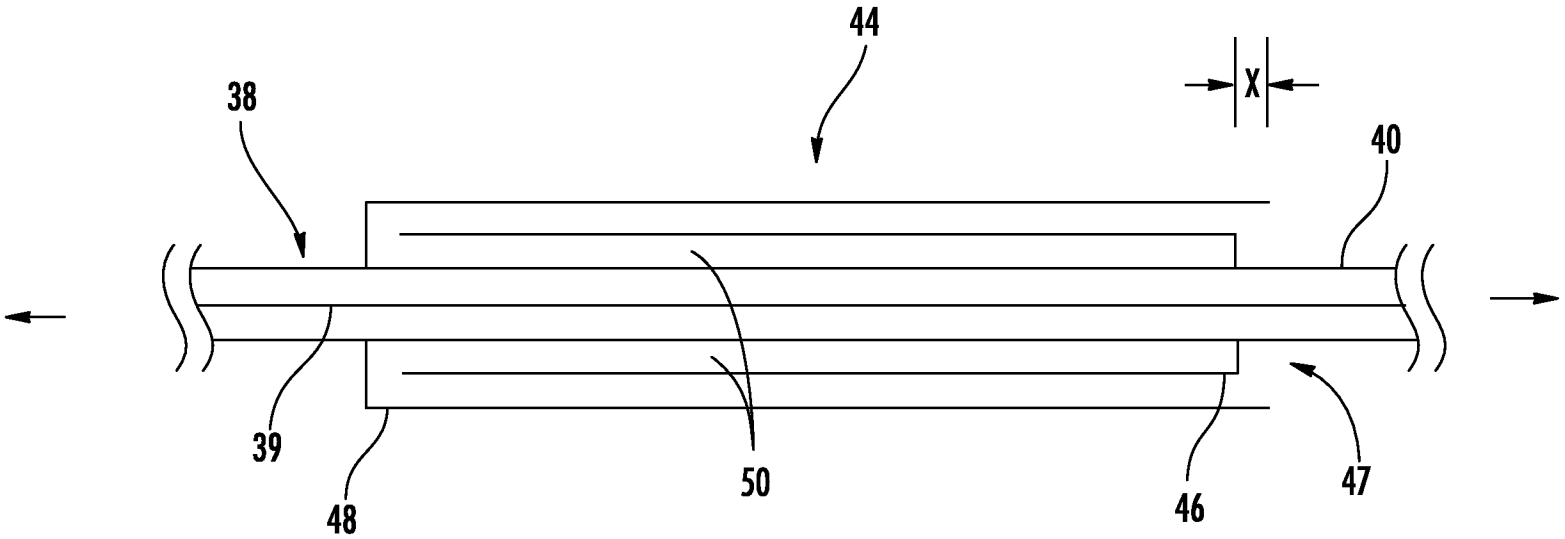
FIG. 2 is a schematic diagram illustrating further details of an embodiment of the compound current choke of the system in FIG. 1.

Referring additionally to FIG. 2, a cross sectional view, a compound current choke 44 is positioned on the transmission line 38 between the RF source 34 and RF antenna 35. A controller (not shown) may be coupled to the compound current choke 44 and may include a controllable DC power source. The compound current choke 44 is tuned to reduce a common mode current 41 from propagating on an outside of the transmission line 38 toward the RF source 34.

As illustrated in the embodiment of FIG. 2, the compound current choke 44 includes a plurality of spaced apart, overlapping, electrically conductive sleeves 46/48, e.g. metallic cylinders, such as copper cylinders, positioned on the transmission line 38 and each including a closed end electrically connected to the outer conductor 40 thereof. The conductive choke sleeves 46/48 include a second end (e.g. an open end) opposite the closed end. The plurality of spaced apart, overlapping, electrically conductive sleeves 46/48 have respective circular cross-sections of progressively increasing diameter from an innermost electrically conductive sleeve 46 to an outermost electrically conductive sleeve 48.

High impedance end 47 provides a high electrical impedance to stop the flow of common mode electrical current. Dimension x depicts a recess of the inner sleeves that may increase arc over distance. For example, at 5 megawatts of RF power, tens of kilovolts are contemplated there.

A fill media 50 is surrounded by the conductive choke sleeves 46/48 adjacent the transmission line 38. The fill media may include a dielectric media or saturable magnetic core, such as ferrite, magnetic spinel, powdered iron, penta-carbonyl E iron, ferrite lodestone, magnetite and steel laminate. The fill media may be a liquid biasable media 50 such as a ferrofluid or a cast biasable media such as mixture of magnetic particles and a binder such as silicon rubber. Magnetic fields tend to act inside atoms while electric fields interact between atoms, so magnetic media may be biased by a quiescent magnetic field to control magnetic media relative permeability, which may in turn adjust compound choke 44 resonant frequency. Further details of such approach are described in the copending U.S. patent application associated with Ser. No. 13/657,172 which is incorporated by reference.

In an alternate embodiment, the FIG. 2 compound current choke 44 may be reversed in direction. Reversing the compound current choke 44 allows RF heating along the length of the compound choke 44.

Figure 3:
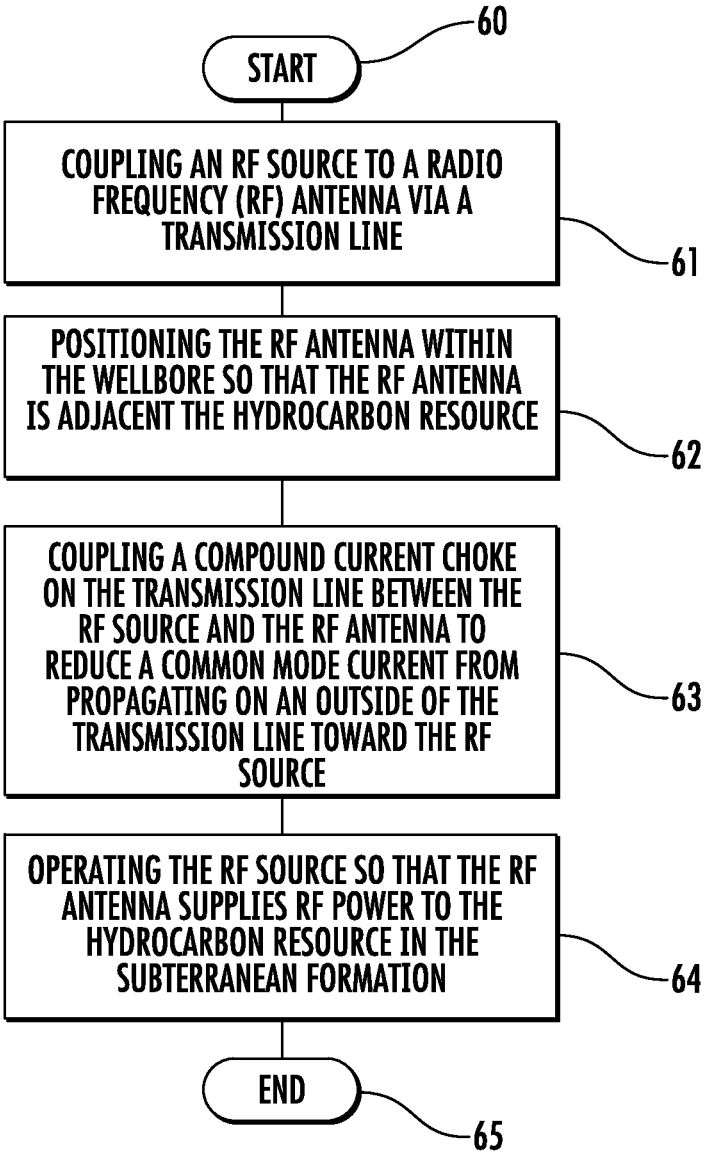
FIG. 3 is flowchart illustrating steps of a method in accordance with an embodiment of the present invention.

A method aspect will be described with reference to the flowchart in FIG. 3. The method is for heating a hydrocarbon resource 31 in a subterranean formation having a wellbore 33 extending therein. The method begins 60 and includes coupling an RF source 34 to a radio frequency (RF) antenna 35 via a transmission line 38 (block 61), and, at block 62, positioning the RF antenna 35 within the wellbore 33 so that the RF antenna 35 is adjacent the hydrocarbon resource 31.

At block 63, the method continues with coupling a compound current choke 44 on the transmission line 38 between the RF source 34 and the RF antenna 35 to reduce a common mode current 41 from propagating on an outside of the transmission line 38 toward the RF source 34. At block 64, the method includes operating the RF source 34 so that the RF antenna 35 supplies RF power to the hydrocarbon resource 31 in the subterranean formation before ending at 65.

Coupling the compound current choke 44 includes positioning a conductive choke sleeve 46 on the transmission line 38 and electrically connecting a closed end to the outer conductor 40 thereof. A fill media 50 is provided within the conductive choke sleeve 46 adjacent the transmission line 38.

Figures 4A, 4B, 4C, 4D:
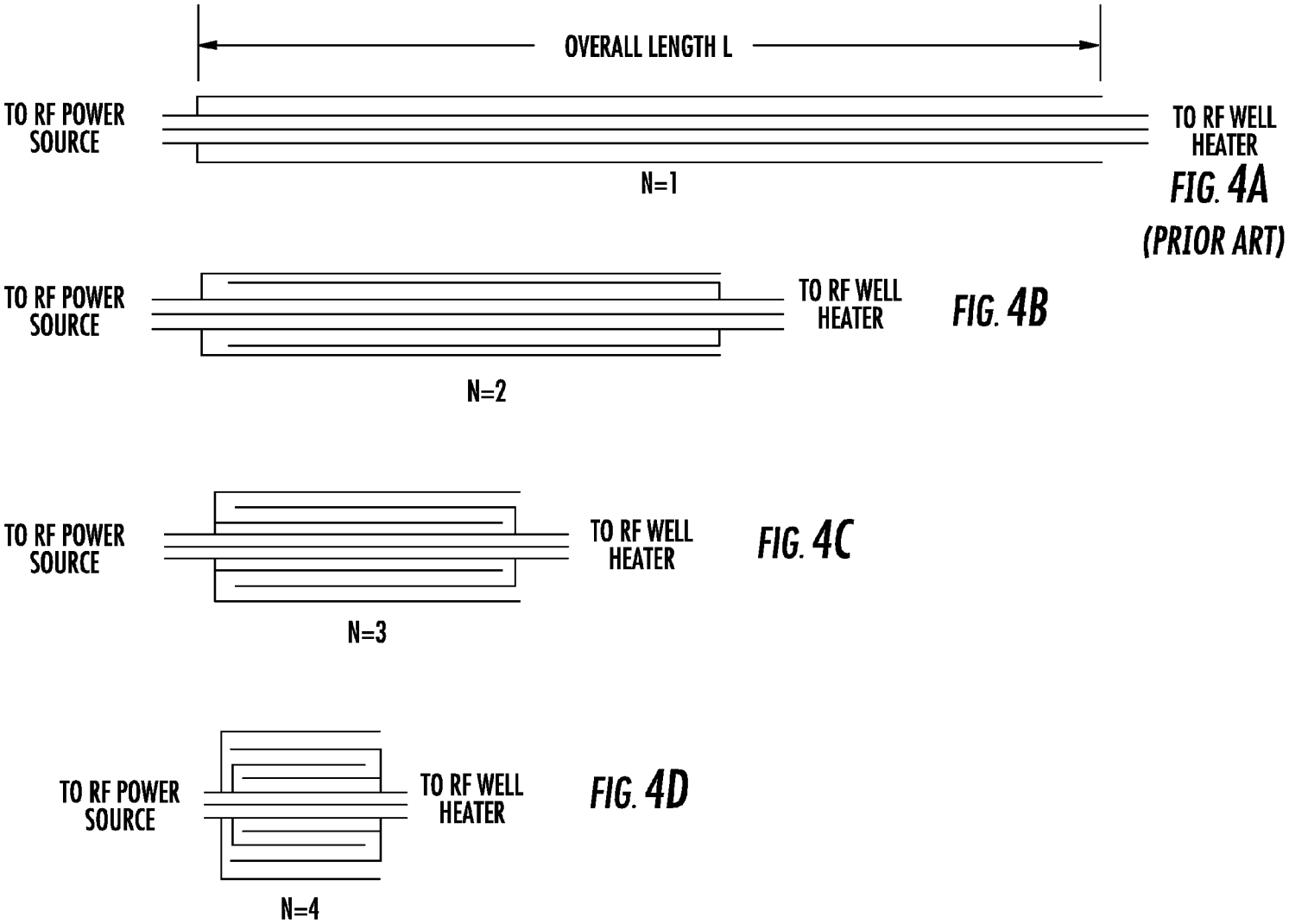
FIG. 4A (PRIOR ART)
FIGS. 4A-4D are schematic diagrams illustrating a comparison of an existing current choke with embodiments of the compound current choke of the present invention.

Referring now additionally to the comparison illustrated in FIG. 4 of an existing current choke (n=1) with embodiments of the compound current choke 44 of the present invention, it should be noted that the compound current choke 44 preferably has a length inversely proportional to a number n of the plurality of spaced apart, overlapping, electrically conductive sleeves. The length L is defined by $L=c/4nf\sqrt{(\in_r\mu_r)}$, where c is the speed of light in feet per second, n is a number of electrically conductive sleeves, f is frequency in Hertz of the RF source, $\in_r$ is the relative permittivity (dimensionless) of the fill material, and $\mu_r$ is the relative permeability (dimensionless) of the fill material.

Accordingly, it will be appreciated that an improved approach for reducing or eliminating a common mode current 41 from having undesirable effects during subterranean RF heating of hydrocarbon resources 31 is described herein. Such RF currents 41 (i.e. common mode current) are reduced or eliminated from propagating up the outside of the coaxial cable 38. As such, unwanted overburden 42 heating or hazardous surface 32 heating is reduced and/or prevented.

Figure 5:
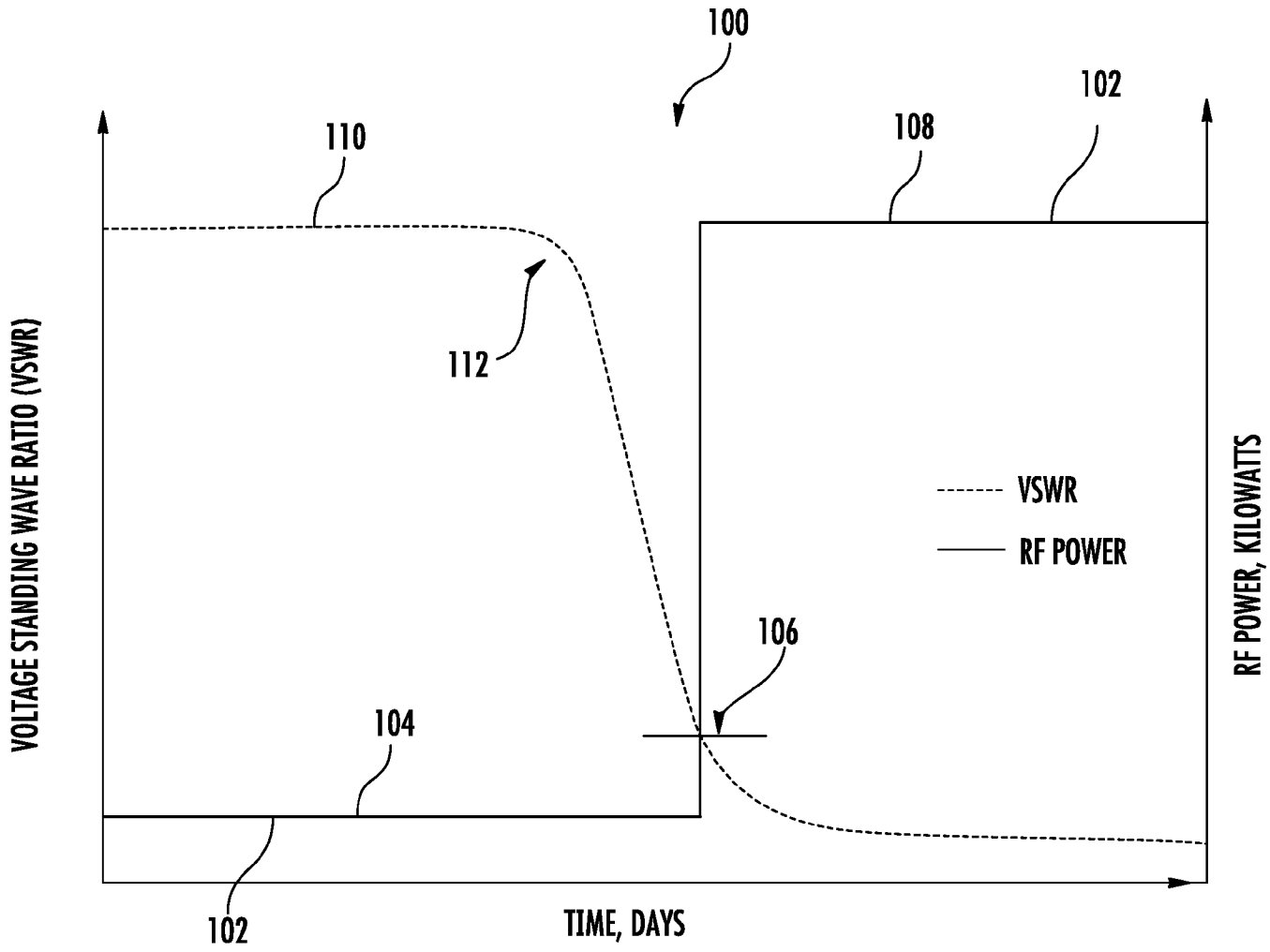
FIG. 5 is a diagram showing a startup method of the present invention.

Referring to FIG. 5, graph 100, a startup procedure RF power is initially applied and maintained at startup power level 104 until such time as the situ water, such as a connate pore water, boils off of the compound current choke 44 open end 47. If open end 47 is uninsulated electrically from the hydrocarbon resource 31, boiloff may be accompanied by a sharp reduction in voltage standing wave ratio (VSWR) 110 corresponding to knee 112. At the selected VSWR threshold 106 RF power from the source 34 may be increased to production power level 108. Production power level 108 may be in a range of 5 to 50 times the startup power level 104. Production power levels may be in a range of 1 to 10 kilowatts per meter along the wellbore, where extraction is to occur. RF power level may be varied to regulate hydrocarbon production rate as well. A synergy of the FIG. 5 startup method is that end 47 concentrates electric fields to cause heating in the ore adjacent the open end 47. The FIG. 5 method was tested in a 120 kilowatt pilot system and found effective as minimal uphole heating occurred.

Figure 6:
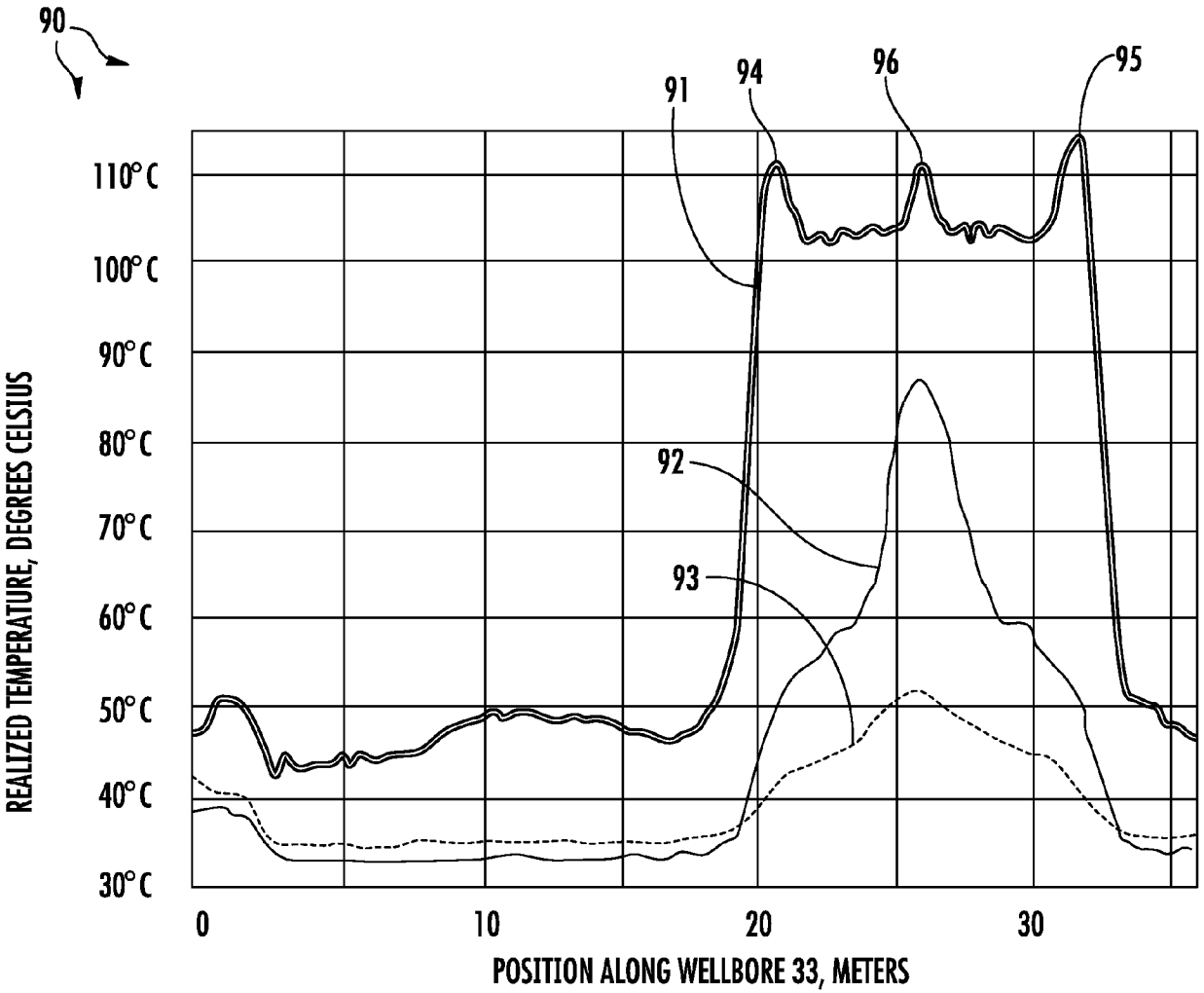
FIG. 6 is a graph showing the subterranean temperatures realized during a test of the embodiments of the present invention.

Referring now to FIG. 6, diagram 90, the heating effects of the 120 kilowatt pilot RF heating apparatus (referred to above with reference to FIG. 5) using a compound current choke 44 embodiment will now be described. To make the measurements, subterranean formation 32 was instrumented with temperature and pressure sensors during the test. RF antenna 35 comprised a center fed half wave dipole operated at 6.78 MHz. Initial subterranean formation 32 electrical conductivity was about 0.002 mhos/meter. In particular, the diagram 90 shows the measured realized temperatures after 44 hours of pilot test RF heating using 86 kilowatts of power from the RF source 34. Trace 91 was the measured temperature immediately aside the wellbore 33. Realized temperatures further from the wellbore 33 are depicted by traces 92, 93, which correspond to 1 and 2.5 meters radii respectively. Hotspot 94 formed due to capacitive coupling of increased electric near fields at the open end 47. Hotspot 96 corresponded to increased electric fields at the dipole center insulator electrical discontinuity. Hotspot 95 was located at the downhole end of the half wave dipole and was again caused by locally increased E fields.

Connate water boil off limited the hotspot temperatures to less than 120° C., as water vapor is not a RF heating susceptor while liquid water is. Process temperatures can vary with reservoir depth/water pore pressure, duration of the heating, power level. It is contemplated that subterranean extraction temperatures may be reduced by injection of solvents such as alkanes. Solvent molecular weight may select process temperature as it determines the subterranean boiling temperature, for instance (C3) propane may be injected for a lower subterranean process temperature and (C4) butane for a higher process temperature.

Deeper heating from the wellbore 33 was by induction with magnetic near fields to create eddy electric currents in the subterranean formation 32. Generally, magnetic field induction heating predominates at greater radial distances and a cylindrical, ablate spheroid or football shape heated zone is created. Open end 47 was located at 18 meters position along x axis in the figure, and advantageously, it prevented unwanted RF heating uphole as can be seen. Temperature rise between about 0 and 3 meters x axis position was due to the sun and rain at the surface. Trace 91 temperature rise between 3 and 18 meters axial position was due to thermal conduction heating from hot oil and water which mobilized into the system 30 wellbore. As can be seen from trace 91, RF heating has much greater speed and penetration than thermal conduction heating. Gurgling noises were heard from the wellbore as the water boiled off in the hole. At the time the pilot test was terminated the RF heated zone was continuing to grow and the heating could have been extended. A RF heated zone of virtually any required reservoir thickness may be reliably created by the system 30.

In oil sand, radio frequency electromagnetic heating produces oil that is upgraded compared to that produced by SAGD or the Clark Hot Water Process. For example, the cumulative mole fractions of the carbon components in a RF produced oil from Athabasca oil sand are: C6, 0.01; C18, 0.31; C30, 0.74. For comparison, the cumulative mole fractions of the carbon components of Clark Hot Water process bitumen are: C6, <0.01; C18, 0.08; C30, 0.30. From the same ore, the viscosity in Centipoise of RF produced oil may be: 20° C., 38,000; 50° C., 1800; 140° C., 28. Clark Hot Water Process bitumen viscosity: 20° C., 190,000; 50° C., 130,000; 140° C., 45. RF produced oil from oil sand can be paraffinic while Clark Hot Water Process bitumen asphaltic. RF produced oil may therefore be about half the molecular weight of Clark bitumen and richer in hydrogen. The RF upgrading may be partially permanent (molecular breakdown) and partially temporary (asphaltene aggregation, rheological).

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A system for heating a hydrocarbon resource in a subterranean formation having a wellbore extending therein, the system comprising:

a radio frequency (RF) source;

an RF antenna configured to be positioned within the wellbore;

a transmission line coupling the RF source and the RF antenna; and a compound current choke surrounding the transmission line and comprising a plurality of spaced apart, overlapping, electrically conductive sleeves, with successive electrically conductive sleeves having a first open end and a second closed end alternating from an innermost electrically conductive sleeve to an outermost electrically conductive sleeve.

2. The system according to claim 1 wherein each second closed end is coupled to said transmission line.

3. The system according to claim 1 wherein said plurality of spaced apart, overlapping, electrically conductive sleeves have respective circular cross-sections of progressively increasing diameter from an innermost electrically conductive sleeve to an outermost electrically conductive sleeve.

4. The system according to claim 1 wherein the transmission line comprises a coaxial transmission line comprising an inner conductor and an outer conductor surrounding said inner conductor; and wherein said compound current choke is coupled to said outer conductor.

5. The system according to claim 1 wherein each of said plurality of spaced apart, overlapping, electrically conductive sleeves comprises copper.

6. The system according to claim 1 wherein said RF antenna comprises a dipole antenna.

7. The system according to claim 1 wherein said compound current choke has a length inversely proportional to a number of said plurality of spaced apart, overlapping, electrically conductive sleeves.

8. The system according to claim 7 wherein said compound current choke further comprises a fill material within spaces defined between said plurality of spaced apart, overlapping, electrically conductive sleeves and the transmission line.

9. The system according to claim 8, wherein the length L is defined by $L=c/4nf\sqrt{(\in_r\mu_r)}$, where c is the speed of light in feet per second, n is a number of electrically conductive sleeves, f is frequency in Hertz of the RF source, $\in_r$ is the relative permittivity of said fill material, and $\mu_r$ is the relative permeability of said fill material.

10. A compound current choke for use with a transmission line and associated radio frequency (RF) antenna for heating a hydrocarbon resource in a subterranean formation, the compound current choke comprising:

a plurality of spaced apart, overlapping, electrically conductive sleeves, each having a first open end and a second closed end to be coupled to the transmission line, with successive electrically conductive sleeves having a first open end and a second closed end alternating from an innermost electrically conductive sleeve to an outermost electrically conductive sleeve.

11. The compound current choke according to claim 10 wherein said plurality of spaced apart, overlapping, electrically conductive sleeves have respective circular cross-sections of progressively increasing diameter from an innermost electrically conductive sleeve to an outermost electrically conductive sleeve.

12. The compound current choke according to claim 10 wherein the transmission line comprises a coaxial transmission line comprising an inner conductor and an outer conductor surrounding the inner conductor.

13. The compound current choke according to claim 10 wherein each of said plurality of spaced apart, overlapping, electrically conductive sleeves comprises copper.

14. The compound current choke according to claim 10 wherein said plurality of spaced apart, overlapping, electrically conductive sleeves define a length inversely proportional to a number of said plurality of spaced apart, overlapping, electrically conductive sleeves.

15. The compound current choke according to claim 14 further comprising a fill media within spaces defined between said plurality of spaced apart, overlapping, electrically conductive sleeves and the transmission line.

16. The compound current choke according to claim 15 wherein the length L is defined by $L=c/4nf\sqrt{(\in_r\mu_r)}$, where c is the speed of light in feet per second, n is a number of electrically conductive sleeves, f is frequency in Hertz of an RF source coupled to the RF antenna, $\in_r$ is the relative permittivity of said fill material, and $\mu_r$ is the relative permeability of said fill material.

17. A method for heating a hydrocarbon resource in a subterranean formation having a wellbore extending therein, the method comprising:

supplying radio frequency (RF) power, from an RF source and via a transmission line, to an RF antenna positioned within the wellbore; and reducing a common mode current from propagating on an outside of the transmission line toward the RF source using a compound current choke surrounding the transmission line and comprising a plurality of spaced apart, overlapping, electrically conductive sleeves, with successive electrically conductive sleeves having a first open end and a second closed end alternating from an innermost electrically conductive sleeve to an outermost electrically conductive sleeve.

18. The method according to claim 17 wherein each second closed end is coupled to the transmission line.

19. The method according to claim 17 wherein said plurality of spaced apart, overlapping, electrically conductive sleeves have respective circular cross-sections of progressively increasing diameter from an innermost electrically conductive sleeve to an outermost electrically conductive sleeve.

20. The method according to claim 17 wherein the transmission line comprises a coaxial transmission line comprising an inner conductor and an outer conductor surrounding the inner conductor; and wherein the compound current choke is coupled to the outer conductor.

21. The method according to claim 17 wherein the compound current choke further comprises a fill material within spaces defined between the plurality of spaced apart, overlapping, electrically conductive sleeves and the transmission line.

* * * * *